US008913914B2

(12) United States Patent
Noguchi

(10) Patent No.: US 8,913,914 B2
(45) Date of Patent: Dec. 16, 2014

(54) IMAGE FORMING APPARATUS

(71) Applicant: KYOCERA Document Solutions Inc., Osaka-shi, Osaka (JP)

(72) Inventor: Youhei Noguchi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 70 days.

(21) Appl. No.: 13/727,961

(22) Filed: Dec. 27, 2012

(65) Prior Publication Data

US 2013/0170852 A1 Jul. 4, 2013

(30) Foreign Application Priority Data

Dec. 28, 2011 (JP) ..... 2011-288346

(51) Int. Cl.
*G03G 15/20* (2006.01)
*G03G 21/16* (2006.01)
*G03G 21/20* (2006.01)

(52) U.S. Cl.
CPC ..... *G03G 15/2078* (2013.01); *G03G 21/1685* (2013.01); *G03G 21/206* (2013.01)
USPC ..... 399/92; 399/122; 399/320

(58) Field of Classification Search
CPC . G03G 21/20; G03G 21/206; G03G 15/2064; G03G 15/2078; G03G 21/1685
USPC ..... 399/91–93, 122, 320, 328
See application file for complete search history.

(56) References Cited

U.S. PATENT DOCUMENTS

| | | | | |
|---|---|---|---|---|
| 6,101,351 | A | 8/2000 | Suda et al. | |
| 2009/0010672 | A1* | 1/2009 | Watanabe | 399/92 |
| 2011/0110679 | A1* | 5/2011 | Nishikawa | 399/92 |

FOREIGN PATENT DOCUMENTS

| | | |
|---|---|---|
| JP | 5-27531 | 2/1993 |

* cited by examiner

*Primary Examiner* — David Gray
*Assistant Examiner* — Jessica L Eley
(74) *Attorney, Agent, or Firm* — Gerald E. Hespos; Michael J. Porco; Matthew T. Hespos

(57) ABSTRACT

An image forming apparatus includes a housing, a sheet conveyance path, a toner containing unit, a fixing unit, a fixing housing, a heat insulation member, a first hot air exhaust passage, a second hot air exhaust passage and a third hot air exhaust passage. The fixing housing houses the fixing unit and includes a wall portion facing the toner containing unit. The heat insulation member shields between the wall portion and the toner containing unit. The first hot air exhaust passage is arranged between the heat insulation member and the toner containing unit. The second hot air exhaust passage communicates with the first hot air exhaust passage. The third hot air exhaust passage is arranged between the wall portion and the heat insulation member and includes an opening facing the sheet conveyance path and a communication port communicating with the second hot air exhaust passage.

9 Claims, 7 Drawing Sheets

IMAGE FORMING APPARATUS

This application is based on Japanese Patent Application Serial No. 2011-288346 filed with the Japan Patent Office on Dec. 28, 2011, the contents of which are hereby incorporated by reference.

BACKGROUND

The present disclosure relates to an image forming apparatus for applying an image forming process to a sheet and particularly to an image forming apparatus with a hot air exhaust passage for exhausting heat generated from a fixing unit to the outside of the apparatus.

An image forming apparatus is provided with various components and members which serve as heat sources and devices including them. For example, a fixing device for applying a fixing process to a sheet having a toner image transferred thereto can be cited as such. To discharge heat generated by these heat source devices, the image forming apparatus is provided with a hot air exhaust passage for heat exhaust.

A fan for promoting the heat exhaust is generally mounted on an end part of the above hot air exhaust passage. Due to the operation of the fan, an air flow is generated in the hot air exhaust passage and warm air in the apparatus is discharged to the outside of the apparatus by this air flow. Conventionally, there has been disclosed a technology for causing an air flow generated by the suction of the fan to enter an image forming apparatus and causing heat generated by heat source devices such as a fixing unit to be exhausted.

An area around the fixing unit tends to get hot in the image forming apparatus. If a device containing a toner is arranged in such an area, the toner may be softened or a plurality of toner particles may be aggregated. As a result, various problems occur in the image forming apparatus. Thus, it is required to exhaust warm air in the area near the fixing unit. However, a cost increase of the entire apparatus is brought about if a fan dedicated for the fixing unit is arranged as in the above conventional technology.

The present disclosure was made in view of the above problem and aims to enhance a heat insulation effect between a fixing unit and peripheral devices.

SUMMARY

An image forming apparatus according to one aspect of the present disclosure includes a housing, a sheet conveyance path, a toner containing unit, a fixing unit, a fixing housing, a heat insulation member, a first hot air exhaust passage, a second hot air exhaust passage and a third hot air exhaust passage. The sheet conveyance path is arranged to extend from a lower side toward an upper side in the housing. The toner containing unit is arranged to face the sheet conveyance path at a first position of the sheet conveyance path and contains a toner inside. The fixing unit faces the sheet conveyance path at a second position of the sheet conveyance path downstream of the first position in a conveying direction and applies a fixing process to the sheet. The fixing housing houses the fixing unit and includes a wall portion facing the toner containing unit. One end of the heat insulation member faces the sheet conveyance path, the other end thereof extends away from the sheet conveyance path and the heat insulation member shields between the wall portion and the toner containing unit. The first hot air exhaust passage is arranged between the heat insulation member and the toner containing unit. The second hot air exhaust passage communicates with the first hot air exhaust passage at the other end of the heat insulation member. The third hot air exhaust passage is arranged between the wall portion and the heat insulation member and includes an opening facing the sheet conveyance path at the one end of the heat insulation member and a communication port communicating with the second hot air exhaust passage at the other end of the heat insulation member.

These and other objects, features and advantages of the present disclosure will become more apparent upon reading the following detailed description along with the accompanying drawings.

DETAILED DESCRIPTION

Figure 1:
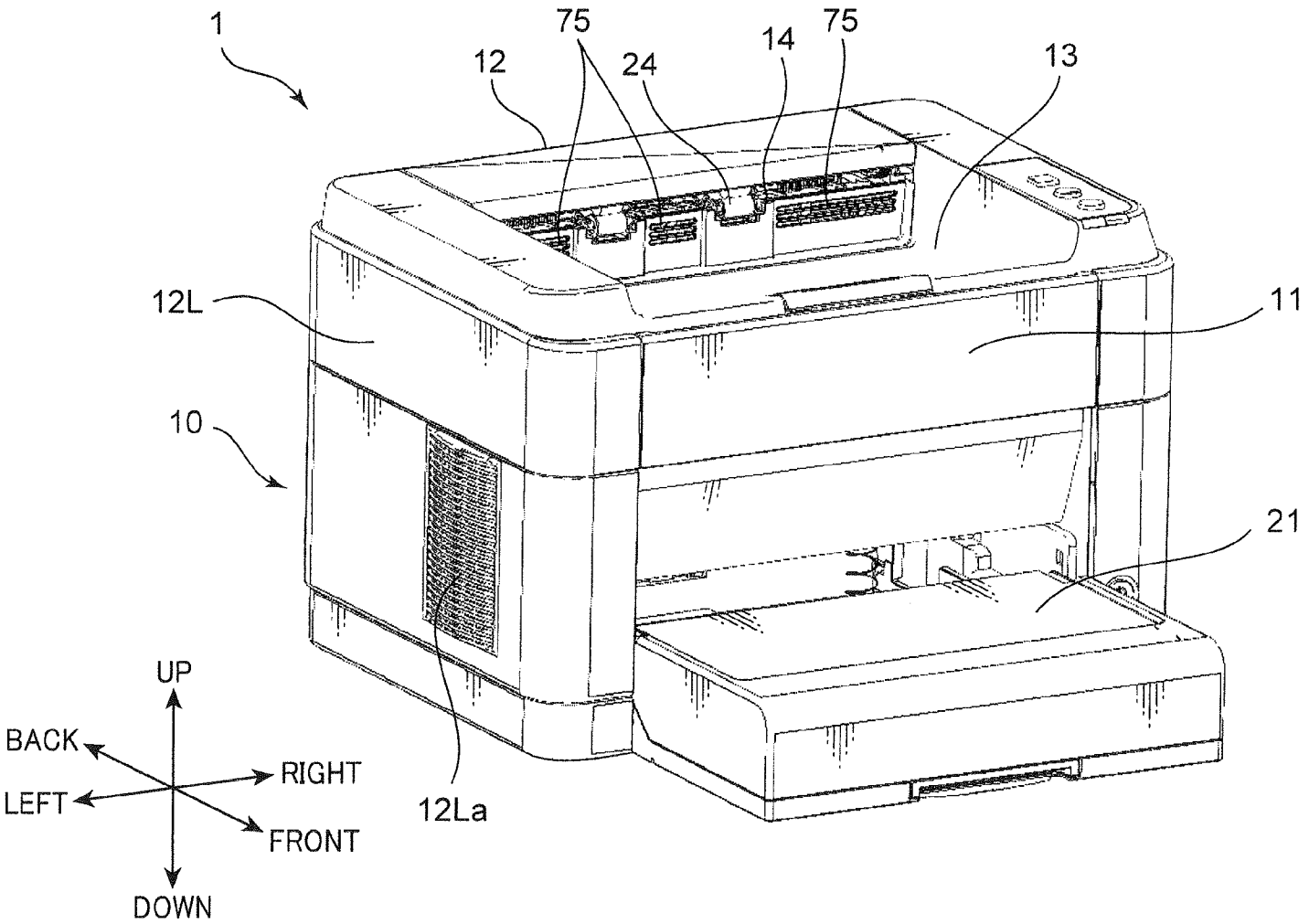
FIG. 1 is a perspective view showing the external appearance of an image forming apparatus according to one embodiment of the present disclosure.
Figure 2:
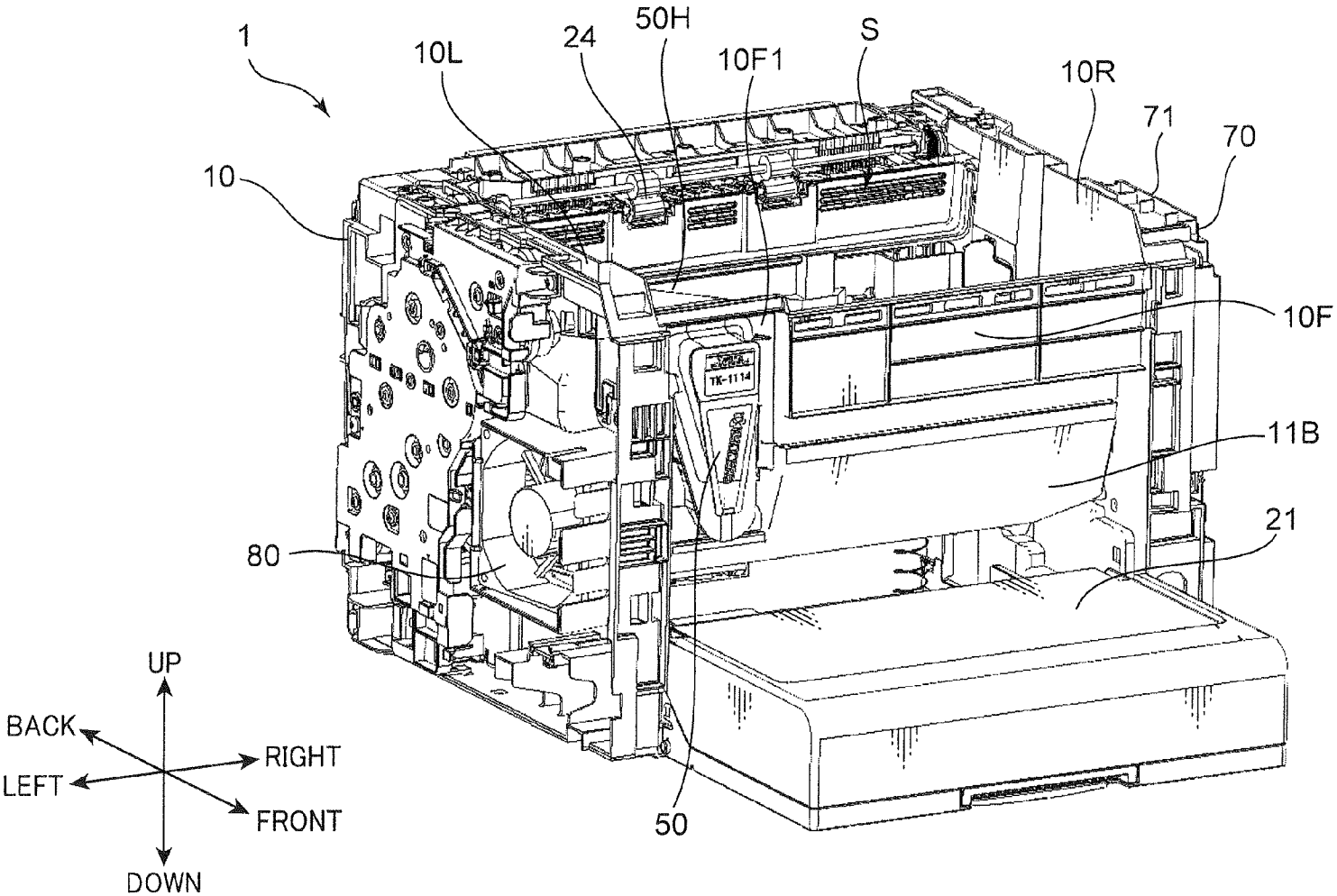
FIG. 2 is a perspective view showing the internal structure of the image forming apparatus according to the one embodiment of the present disclosure.
Figure 3:
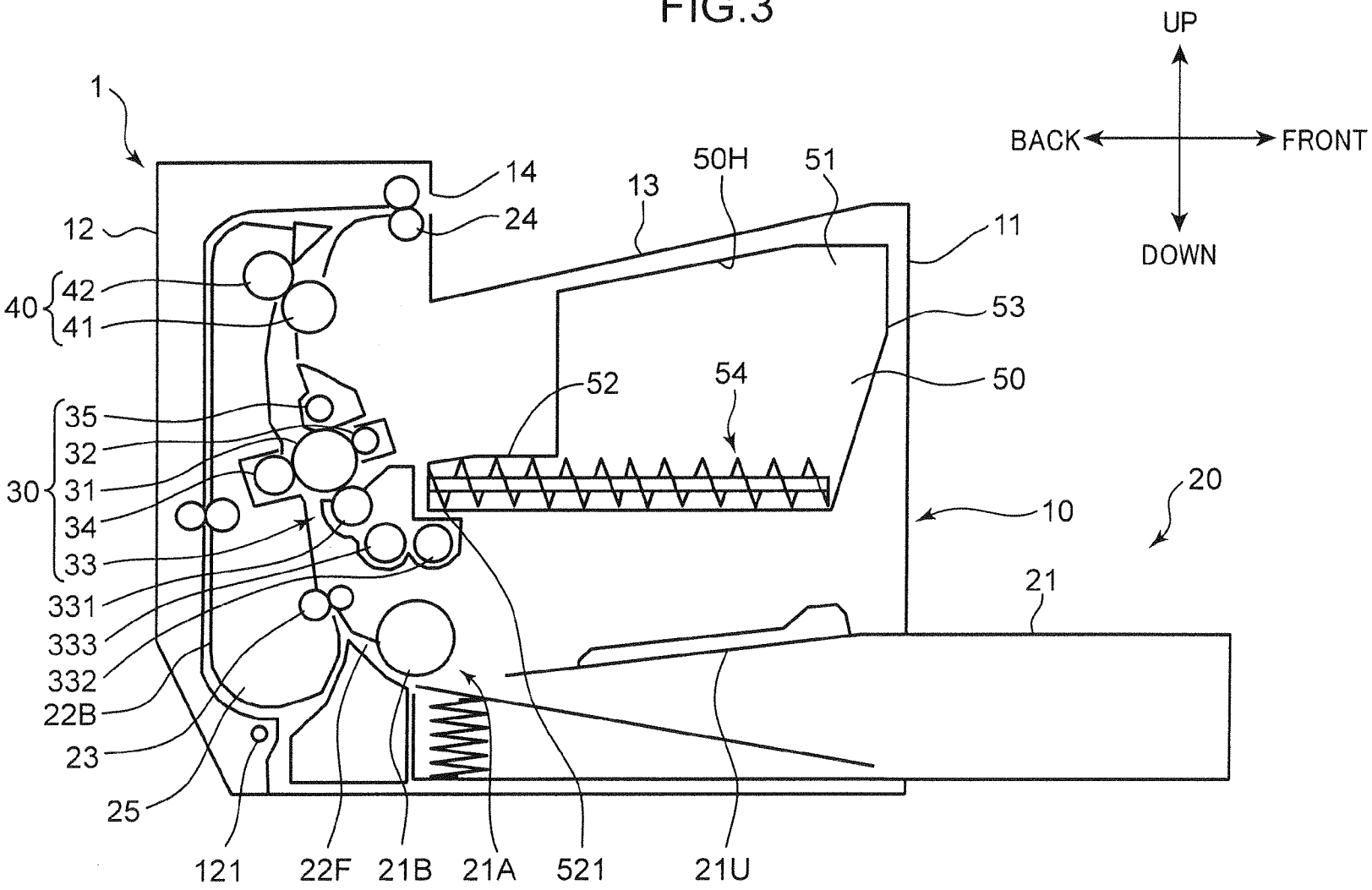
FIG. 3 is a side view in section showing the internal structure of the image forming apparatus according to the one embodiment of the present disclosure.

Hereinafter, an embodiment of the present disclosure is described based on the drawings. FIG. 1 is a perspective view showing the external appearance of an image forming apparatus 1 according to one embodiment of the present disclosure. Further, FIG. 2 is a perspective view showing the internal structure of the image forming apparatus 1 according to the one embodiment of the present disclosure. FIG. 2 shows a state where covers and an image forming unit 30 to be described later are removed in a state of FIG. 1. Furthermore, FIG. 3 is a side view in section showing the internal structure of the image forming apparatus 1 according to the one embodiment of the present disclosure. Although a black-and-white printer is illustrated as the image forming apparatus 1 here, the image forming apparatus may be a copier, a facsimile machine or a complex machine provided with these functions or may be an image forming apparatus for forming a color image.

The image forming apparatus 1 includes a main body housing 10 (housing) having a substantially rectangular parallelepiped housing structure, a sheet feeding unit 20, the image forming unit 30, a fixing unit 40, a toner container 50, a board unit 70 and a cooling fan 80 housed in this main body housing 10.

A front cover 11 and a rear cover 12 are respectively provided on a front surface side and a rear surface side of the main body housing 10. By opening the front cover 11, the toner container 50 is exposed as shown in FIG. 2. This enables a user to take out the toner container 50 from the front surface side of the main body housing 10 when a toner runs out. The rear cover 12 is a cover which is opened at the time of a sheet jam or maintenance. The respective image forming unit 30 and fixing unit 40 can be taken out from the rear surface side of the main body housing 10 by opening the rear cover 12. Further, a left cover 12L (FIG. 1) and a right cover 12R (not shown in FIG. 1) opposite to the left cover 12L are respectively so arranged on side surfaces of the main body housing 10 as to extend in a vertical direction. An air inlet 12La through which air is taken by the cooling fan 80 to be described later is arranged in a front part of the left cover 12L. Further, a sheet discharging portion 13 to which a sheet after image formation is to be discharged is provided on the upper surface of the main body housing 10. Various devices for performing image formation are housed in an inner space S (FIG. 2) defined by the front cover 11, the rear cover 12, the left cover 12L, the right cover 12R and the sheet discharging portion 13.

A left frame 10L and a right frame 10R which are exposed by removing the front cover 11, the rear cover 12, the left cover 12L and right cover 12R stand in the main body housing 10 (FIG. 2). The left frame 10L supports various devices on the side of the left cover 12L of the main body housing 10. Further, the right frame 10R supports various devices on the side of the right cover 12R of the main body housing 10. The image forming unit 30 and the fixing unit 40 extending in a lateral direction are supported by the left frame 10L and the right frame 10R. Further, a front frame 10F extending between the left and right frames 10L, 10R is arranged on the front surface side of the main body housing 10. Furthermore, an inner cover 11B for covering a front inner part of the main body housing 10 is arranged below the front frame 10F. The inner cover 11B is arranged from the left frame 10L to the right frame 10R while facing an upper surface part of a sheet cassette 21. Further, ends of the front frame 10F and the inner cover 11B on the side of the left frame 10L are respectively partly cut out. A front opening 10F1 is formed at this cut-out part and the toner container 50 to be described later is housed therein.

The sheet feeding unit 20 includes the sheet cassette 21 storing sheets to which an image forming process is to be applied (FIG. 3). Apart of this sheet cassette 21 projects further forward from the front surface of the main body housing 10. The upper surface of a part of the sheet cassette 21 housed in the main body housing 10 is covered by a sheet cassette ceiling plate 21U. The sheet cassette 21 includes a sheet storage space in which a stack of sheets is stored, a lift plate for lifting up the stack of sheet for sheet feeding and the like. A sheet pickup unit 21A is provided above a rear end side of the sheet cassette 21. A feed roller 21B for picking up the uppermost sheet of the sheet stack in the sheet cassette 21 one by one is arranged in this sheet pickup unit 21A.

The image forming unit 30 performs an image forming process for forming a toner image on a sheet fed from the sheet feeding unit 20. The image forming unit 30 includes a photoconductive drum 31 (image bearing member) and a charging device 32, an exposure device (not shown in FIG. 3), a developing device 33, a transfer roller 34 and a cleaning device 35 arranged around this photoconductive drum 31. The image forming unit 30 is arranged between the left cover 12L and the right cover 12R, more specifically between the left frame 10L and the right frame 10R.

The photoconductive drum 31 is rotated about its shaft and an electrostatic latent image and a toner image are formed on the circumferential surface thereof. A photoconductive drum made of an amorphous silicon (a-Si) material can be used as the photoconductive drum 31. The charging device 32 is for uniformly charging the surface of the photoconductive drum 31 and includes a charging roller held in contact with the photoconductive drum 31. The cleaning device 35 includes a cleaning blade and the like and cleans the toner adhering to the circumferential surface of the photoconductive drum 31 after the transfer of the toner image and conveys the toner to an unillustrated collecting device. Further, the photoconductive drum 31, the charging device 32 and the cleaning device 35 are integrally configured as a drum unit 30H (see FIG. 4).

The exposure device includes optical devices such as a laser light source, a mirror and a lens and irradiates the circumferential surface of the photoconductive drum 31 with light modulated based on image data given from an external apparatus such as a personal computer, thereby forming an electrostatic latent image. The developing device supplies a toner to the circumferential surface of the photoconductive drum 31 to develop the electrostatic latent image formed on the photoconductive drum 31 and form a toner image. The developing device 33 includes a developing roller 331 for bearing the toner to be supplied to the photoconductive drum 31 and a first conveyor screw 332 and a second conveyor screw 333 for conveying a developer in a circulating manner while agitating the developer in an unillustrated development housing.

The transfer roller 34 is a roller for transferring the toner image formed on the circumferential surface of the photoconductive drum 31 onto a sheet and forms a transfer nip portion together with the photoconductive drum 31. A transfer bias having a polarity opposite to that of the toner is applied to this transfer roller 34.

The fixing unit 40 performs a fixing process for fixing a transferred toner image onto a sheet. The fixing unit 40 includes a fixing roller 41 internally provided with a heat source and a pressure roller 42 pressed in contact with this fixing roller 41 and forming a fixing nip portion together with the fixing roller 41. When a sheet having a toner image transferred thereto is passed through the fixing nip portion, the toner image is fixed onto the sheet by heating by the fixing roller 41 and pressing by the pressure roller 42. The fixing unit 40 is housed in a box-shaped fixing housing 40H (see FIG. 4).

The toner container 50 stores the toner to be supplied to the developing device 33. The toner container 50 includes a container main body 51 as a main storage part for the toner, a tubular portion 52 projecting from a lower part of one side surface of the container main body 51, a lid member 53 covering the other side surface of the container main body 51, and a rotary member 54 housed in the container for conveying the toner. The toner stored in the toner container 50 is supplied into the developing device 33 through a toner discharge opening 521 provided on the lower surface of the leading end of the tubular portion 52 by driving and rotating the rotary member 54. This toner container 50 is arranged at an upper position at an inner side of the left frame 10L (FIG. 2). Further, a container ceiling plate 50H covering an upper side of the toner container 50 is located below the sheet discharging portion 13 (see FIG. 3).

A main conveyance path 22F (sheet conveyance path) and a reversing conveyance path 22B are provided to convey a sheet in the main body housing 10. The main conveyance path 22F extends from the sheet pickup unit 21A of the sheet feeding unit 20 to a sheet discharge opening 14 provided to face the sheet discharge portion 13 on the upper surface of the main body housing 10 by way of the image forming unit 30 and the fixing unit 40. The reversing conveyance path 22B is a conveyance path for returning a sheet, one side of which is printed, to a side of the main conveyance path 22F upstream of the image forming unit 30 in the case of printing both sides of the sheet.

A pair of registration rollers 23 are arranged in a side of the main conveyance path 22F upstream of the transfer nip portion between the photoconductive drum 31 and the transfer roller 34. A sheet is temporarily stopped at the pair of registration rollers 23 and fed to the transfer nip portion at a predetermined timing for image transfer after a skew correction is made. A plurality of conveyor rollers for conveying a sheet are arranged at suitable positions of the main conveyance path 22F and the reversing conveyance path 22B, and a pair of discharge rollers 24 are arranged, for example, near the sheet discharge opening 14.

The reversing conveyance path 22B is formed between the outer side surface of a reversing unit 25 and the inner surface of the rear cover 12 of the main body housing 10. Note that the transfer roller 34 and one of the pair of registration rollers 23 are mounted on the inner side surface of the reversing unit 25. The rear cover 12 and the reversing unit 25 are respectively rotatable about a supporting point portion 121 provided at the lower ends thereof. If a sheet jam occurs in the rear conveyance path 22B, the rear cover 12 is opened. If a sheet jam occurs in the main conveyance path 22F or if the unit including the photoconductive drum 31 or the developing device 33 is taken out to the outside, the reversing unit 25 is also opened in addition to the rear cover 12.

The board unit 70 is arranged on the outer (right) side surface of the right frame 10R when viewed from front (FIG. 2). A plurality of circuit boards are consolidated and arranged in the board unit 70.

The cooling fan 80 is arranged on the outer (left) side surface of the left frame 10L when viewed from front and at a front position of the main body housing 10. The cooling fan 80 includes an unillustrated rotary shaft, a motor and a plurality of blade members. The cooling fan 80 rotates when a drive current is supplied to the motor from an unillustrated power supply and rotates while forming a plane of rotation parallel to the left frame 10L. By the rotation of the cooling fan 80, air outside the main body housing 10 is sucked through the air inlet 12La to produce an air flow moving toward the interior of the main body housing 10. In this embodiment, the cooling fan 80 is arranged mainly for the purpose of cooling the board unit 70. The air flow entering the interior of the main body housing 10 is blown toward a lower part of the board unit 70 while passing through a space located below the inner cover 11B and above the sheet cassette 21.

Figure 4:
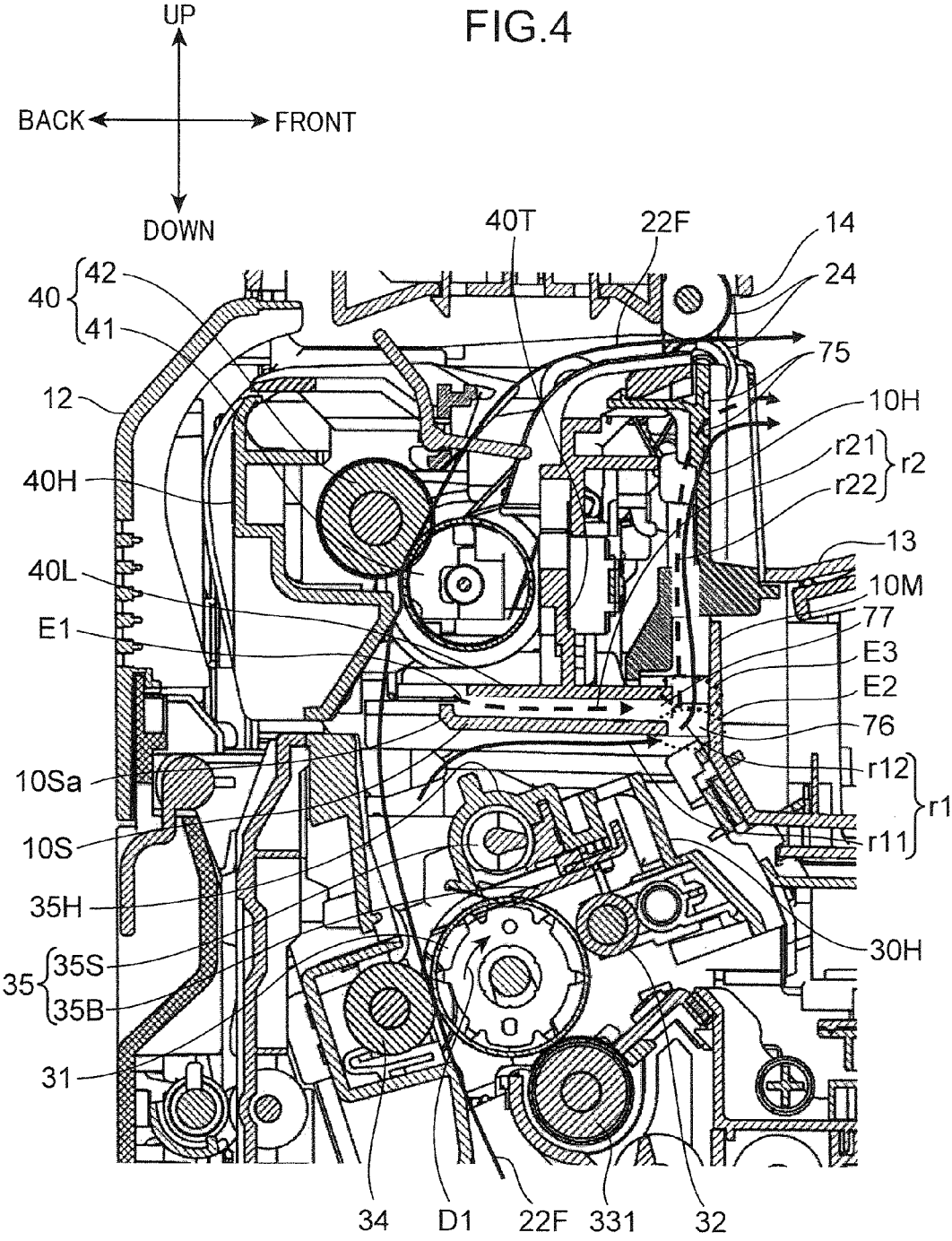
FIG. 4 is a sectional view for explaining hot air exhaust passages of the image forming apparatus according to the one embodiment of the present disclosure.
Figure 5:
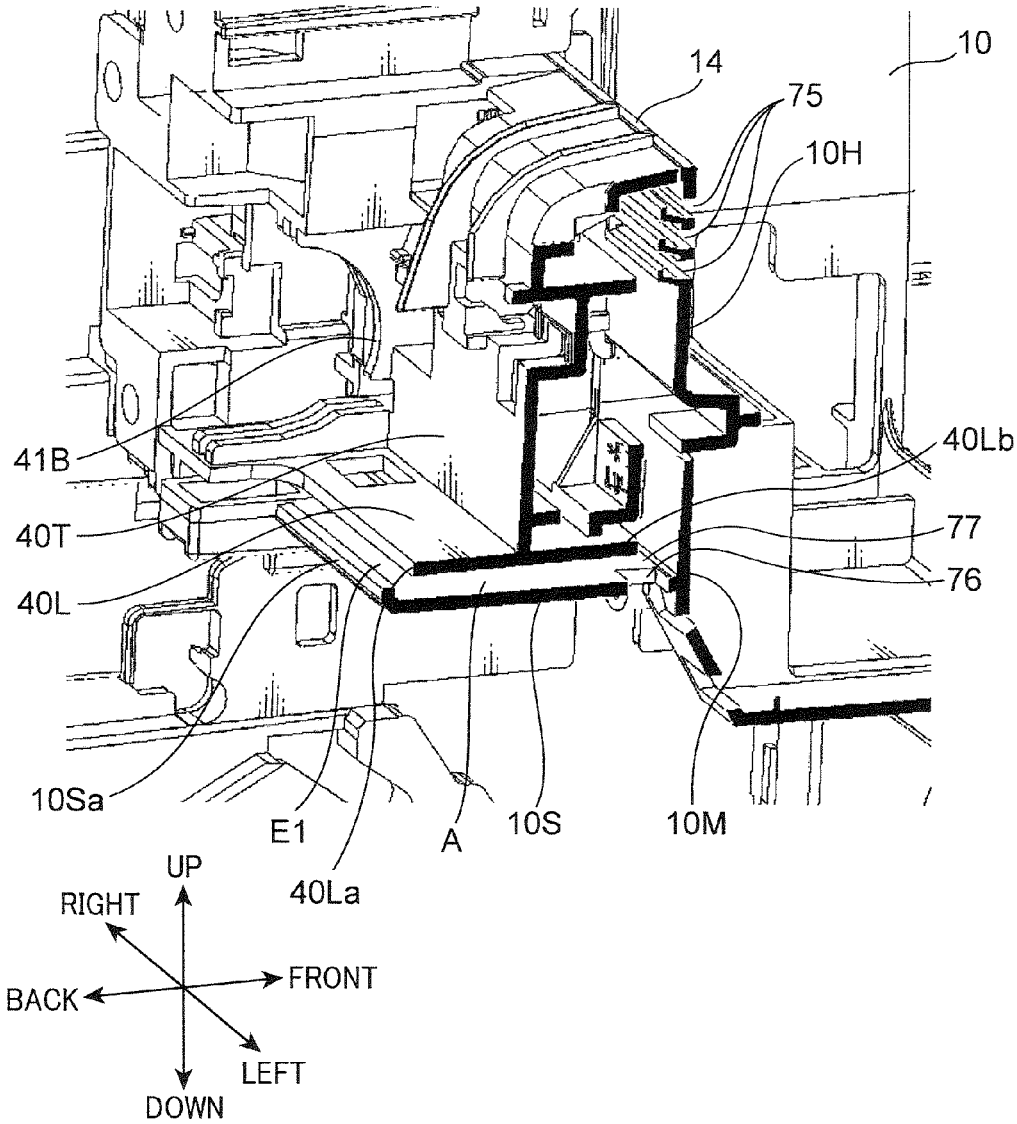
FIG. 5 is a perspective view partly in section for explaining the hot air exhaust passages of the image forming apparatus according to the one embodiment of the present disclosure.
Figure 6:
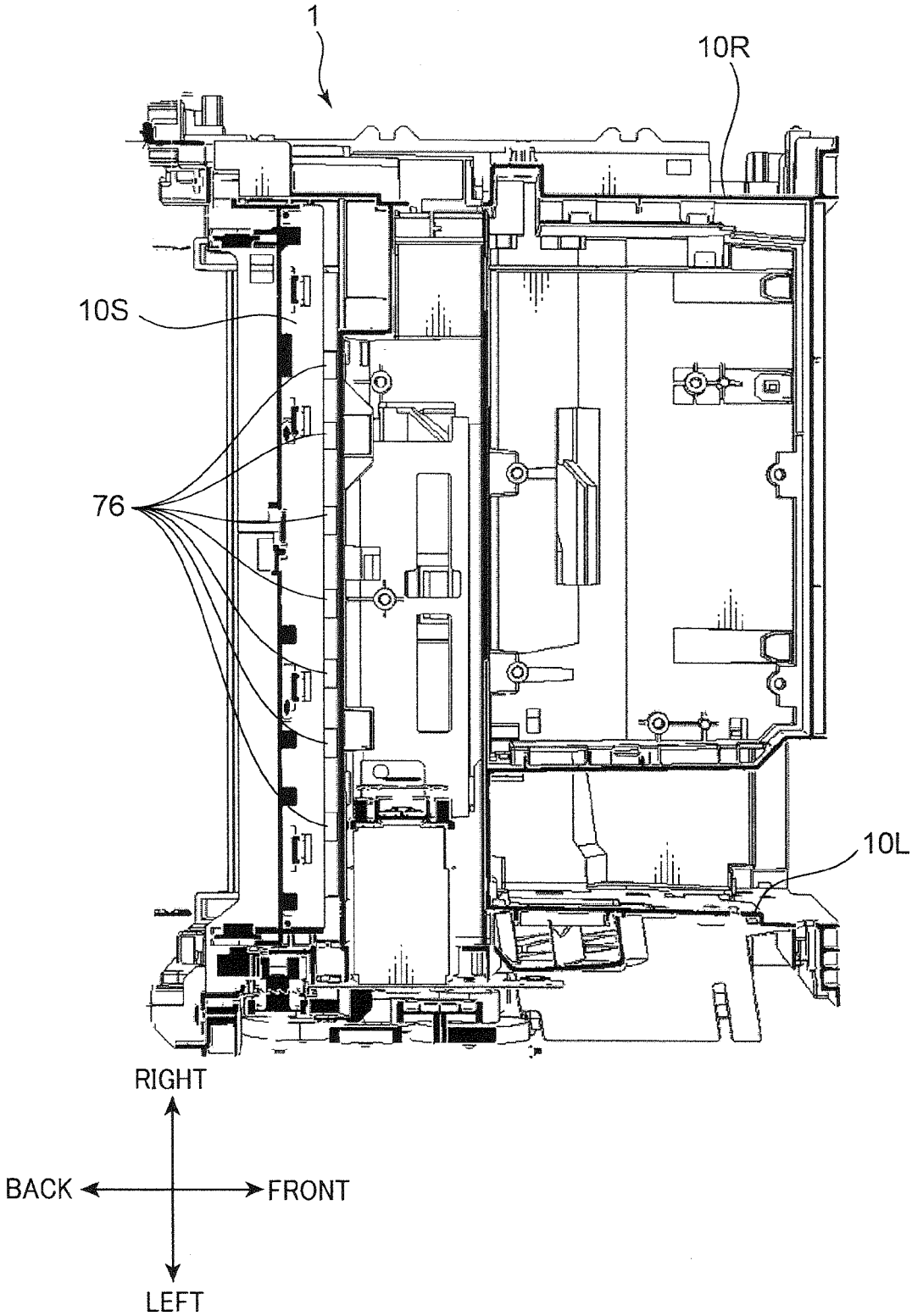
FIG. 6 is a plan view partly in section for explaining the hot air exhaust passages of the image forming apparatus according to the one embodiment of the present disclosure.

Next, the configuration of peripheral parts of the photoconductive drum 31 and the fixing unit 40 is described with reference to FIGS. 4 to 6. FIG. 4 is an enlarged sectional view of the periphery of the photoconductive drum 31 and the fixing unit 40 according to this embodiment. Further, FIG. 5 is a perspective view partly in section showing the periphery of the fixing unit 40 and FIG. 6 is a plan view partly in section of the image forming apparatus 1.

With reference to FIG. 4, a sheet fed from the sheet cassette 21 (FIG. 3) arranged in a lower part of the main body housing 10 is conveyed from a lower side toward an upper side along the main conveyance path 22F (sheet conveyance path). The drum unit 30H (image bearing member unit) is arranged to face the main conveyance path 22F at a predetermined position (first position) of the main conveyance path 22F. A toner image is transferred to the sheet being conveyed between the photoconductive drum 31 and the transfer roller 34 in the drum unit 30H. The fixing unit 40 is arranged to face the main conveyance path 22F at a position (second position) of the main conveyance path 22F downstream of the drum unit 30H in a conveying direction and above the drum unit 30H to face the main conveyance path 22F. The sheet having the toner image transferred thereto is subjected to a fixing process while being nipped between the fixing roller 41 and the pressure roller 42 in the fixing unit 40. The sheet having passed through the fixing unit 40 is conveyed further upward and discharged to the sheet discharging portion 13 through the sheet discharge opening 14 by the pair of discharge rollers 24.

As just described, in this embodiment, the fixing unit 40 is arranged above the drum unit 30H housing the photoconductive drum 31. In the drum unit 30H, the cleaning device 35 for cleaning the surface of the photoconductive drum 31 is arranged at a position closest to the fixing unit 40.

An upper part of the cleaning device 35 is covered by an upper surface portion 35H of the drum unit 30H. The upper surface portion 35H is a cleaner housing for housing the cleaning device 35. The upper surface portion 35H is connected to the drum unit 30H. The cleaning device 35 includes a plate-like cleaning blade 35B which is held in contact with a vertically uppermost part of the photoconductive drum 31 at a predetermined angle. Further, the cleaning device 35 includes a conveyor screw 35S for conveying the toner to the unillustrated collecting device. As the photoconductive drum 31 is rotated in a direction of an arrow D1, the toner scraped off by the cleaning blade 35B is stored into the upper surface portion 35H (cleaner housing) and conveyed toward the unillustrated collecting device by the conveyor screw 35S.

In this embodiment, to maximally reduce the size of the image forming apparatus 1, a distance between the upper surface portion 35H of the drum unit 30H and the fixing housing 40H housing the fixing unit 40 is only about 20 to 30 mm. Accordingly, heat generated by the fixing roller 41 heated to apply the fixing process to a sheet tends to be transferred to the cleaning device 35. If the cleaning device 35 is warmed by this heat, the toner contained inside tends to be softened. A temperature at which the softening of the toner starts differs depending on a toner material used. A glass transition temperature which is one characteristic of a resin material is used as an index for the softening of the toner. For example, if a polyether-based resin is used as a main material of the toner, the softening of the toner starts when toner temperature exceeds 40° C. to 50° C. which is a glass transition temperature. The softening of the toner having occurred in the cleaning device 35 changes outer shapes of toner particles and causes the aggregation of a plurality of toner particles. The aggregated toner particles hinder the conveyance of the toner to the collecting device (not shown) by the conveyor screw 35S and causes incorrect rotation of the conveyor screw 35S, a torque increase and the like. As a result, a failure of the image forming apparatus 1 occurs.

<Structure of Hot Air Exhaust Passages>

To solve such a problem, a first air passage r1 and a second air passage r2 are arranged between the cleaning device 35 and the fixing unit 40 in this embodiment. The first and second air passages r1, r2 are arranged before the main conveyance path 22F in the image forming apparatus 1. The structures of the first and second air passages r1, r2 are described with reference to FIGS. 4 and 5.

The first and second air passages r1, r2 are formed by the fixing housing 40H, the drum unit 30H and a frame supporting the main body housing 10.

The fixing housing 40H includes a fixing roller supporting portion 41B (FIG. 5), a fixing unit standing wall 40T and a fixing housing bottom portion 40L (wall portion). A bearing for supporting the fixing roller 41 is fitted into the fixing roller supporting portion 41B. The fixing unit standing wall 40T stands in a vertical direction at a side of the fixing roller 41 opposite to the main conveyance path 22F. The fixing housing bottom portion 40L is arranged below the fixing roller 41 to form a bottom part of the fixing housing 40H. The fixing housing bottom portion 40L is connected at an angle to the lower end of the fixing unit standing wall 40T. The fixing unit standing wall 40T and the fixing housing bottom portion 40L are in an inverted T-shaped arrangement when viewed sideways. The fixing housing bottom portion 40L is arranged to face the drum unit 30H located below the fixing unit 40. Further, a rear part of the fixing housing bottom portion 40L is arranged to face the fixing roller 41 below the fixing roller 41. On the other hand, a front part of the fixing housing bottom portion 40L extends away from the fixing roller 41 and is arranged to face a main body standing wall lower portion 10M to be described later.

Further, the main body housing 10 includes a heat insulation frame 10S, the main body standing wall lower portion 10M, vents 76, a main body standing wall upper portion 10H and louvers 75.

The heat insulation frame 10S is arranged in parallel to the fixing housing bottom portion 40L below the fixing housing bottom portion 40L. The heat insulation frame 10S is a part of the frame supporting the main body housing 10. The heat insulation frame 10S is a plate member substantially horizontally arranged from the left frame 10L to the right frame 10R (see FIG. 2) when viewed from front. When view sideways, a leading end portion 10Sa (one end) of the heat insulation frame 10S is arranged to face the main conveyance path 22F while being spaced apart therefrom by a predetermined distance (FIGS. 4 and 5). The heat insulation frame 10S is arranged such that an end (other end) opposite to the leading end portion 10Sa extends away from the main conveyance path 22F. The heat insulation frame 10S has a function of insulating (shielding) heat between the fixing unit 40 and the cleaning device 35.

The main body standing wall lower portion 10M faces the heat insulation frame 10S and the fixing housing bottom portion 40L at a side of the heat insulation frame 10S opposite to the main conveyance path 22F and stands in the vertical direction. The main body standing wall lower portion 10M is a part of a cover member of the main body housing 10 and connected at a right angle to a front end part of the heat insulation frame 10S. Further, the main body standing wall lower portion 10M faces the fixing housing bottom portion 40L at a facing portion E3 (FIG. 4).

The vents 76 are arranged near a boundary between the heat insulation frame 10S and the main body standing wall lower portion 10M. The vents 76 are openings formed to penetrate though a part of the heat insulation frame 10S. As shown in FIG. 6, the vents 76 are arranged at a plurality of positions of the heat insulation frame 10S spaced apart in the lateral direction.

The main body standing wall upper portion 10H is a part of the cover member of the main body housing 10 and is vertically arranged while being connected to an upper part of the main body standing wall lower portion 10M. An upper end part of the main body standing wall upper portion 10H forms the lower end of the sheet discharge opening 14 through which a sheet is to be discharged.

The louvers 75 are composed of a plurality of slits formed on an upper end side of the main body standing wall upper portion 10H below the sheet discharge opening 14. The plurality of slits forming the louvers 75 are arranged in the vertical and lateral directions of the main body standing wall upper portion 10H (see FIG. 1). As described above, the louvers 75 are arranged on the upper end part of the main body standing wall upper portion 10H. Thus, the louvers 75 are arranged at a distance in the vertical direction from sheets stacked on the sheet discharging portion 13.

The first air passage r1 is composed of a first horizontal air passage r11 (first hot air exhaust passage) arranged substantially in the horizontal direction and a first vertical air passage r12 (second hot air exhaust passage) arranged substantially in the vertical direction.

The first horizontal air passage r11 is arranged between the heat insulation frame 10S and the upper surface portion 35H of the drum unit 30H.

The first vertical air passage r12 is arranged to extend upward from an area E2 formed by the vents 76 along the main body standing wall lower portion 10M and the main body standing wall upper portion 10H up to the louvers 75. The first horizontal air passage r11 and the first vertical air passage r12 are allowed to communicate by the vents 76.

The second air passage r2 is composed of a second horizontal air passage r21 (third hot air exhaust passage) arranged substantially in the horizontal direction and a second vertical air passage r22 arranged substantially in the vertical direction.

The second horizontal air passage r21 is formed between the fixing housing bottom portion 40L and the heat insulation frame 10S. The second horizontal air passage r21 includes a first flow inlet E1 (opening) on the side of the leading end portion 10Sa of the heat insulation frame 10S. The first flow inlet E1 is defined by an end portion 40La (FIG. 5) of the fixing housing bottom portion 40L on the side of the main conveyance path 22F and the leading end portion 10Sa of the heat insulation frame 10S on the side of the main conveyance path 22F.

The second vertical air passage r22 is arranged in an area from the facing portion E3 to the louvers 75 along the main body standing wall lower portion 10M and the main body standing wall upper portion 10H. In this embodiment, the first vertical air passage r12 and the second vertical air passage r22 are so arranged as to join at the facing portion E3 and, thereafter, share a path up to the louvers 75. The second horizontal air passage r21 communicates with the second vertical air passage r22 at a communication port 77 arranged at a side opposite to the leading end portion 10Sa.

<Functions of Hot Air Exhaust Passages>

Next, functions of the first and second air passages r1, r2 according to this embodiment are described with reference to FIG. 4. The operation of the image forming apparatus 1 is performed, the fixing roller 41 is heated and a sheet is conveyed upward along the main conveyance path 22F. At this time, air on a sheet surface moves together with the sheet to produce a laminar flow as the sheet is conveyed. Then, this laminar flow (air flow in the sheet conveyance path) enters the first horizontal air passage r11 from the leading end portion 10Sa of the heat insulation frame 10S by conveying the sheet from the photoconductive drum 31 toward the fixing unit 40. As a result, an air flow moving toward the main body standing wall lower portion 10M (front side) is produced in the first horizontal air passage r11. This air flow further moves toward the main body standing wall lower portion 10M in the first horizontal air passage r11 due to the momentum of the flow itself and a function of being pushed by the laminar flow further fed from the main conveyance path 22F. Then, this air flow exits through the vents 76 and enters the first vertical air passage r12 and, after ascending, is discharged to the outside of the apparatus.

In this way, the laminar flow produced by the sheet being conveyed contacts the upper surface portion 35H of the drum unit 30H when passing along the first horizontal air passage r11. Thus, the upper surface portion 35H is cooled by the laminar flow. This can suppress the transfer of heat from the fixing unit 40 to the drum unit 30H. This, in turn, suppresses the softening and aggregation of the toner adhering to the photoconductive drum 31 in the drum unit 30H. As a result, an increase in the rotational torque of the photoconductive drum 31 and the adhesion of the toner to the surface of the photoconductive drum 31 due to the softened and aggregated toner are prevented.

Further, the cooling fan 80 arranged at a lower part of the left cover 12L to cool the board unit 70 introduces an air flow into the interior of the main body housing 10 through the air inlet 12La (see FIGS. 1 and 2). Thus, new air is easily introduced into a lower space in the main body housing 10. Therefore, a laminar flow moving upward is more easily produced by a sheet being conveyed upward along the main conveyance path 22F.

Further, as described above, the heat insulation frame 10S effectively insulates heat transferred from the fixing roller 41 of the fixing unit 40 toward the drum unit 30H.

Further, in this embodiment, the second horizontal air passage r21 is arranged between the heat insulation frame 10S and the fixing housing bottom portion 40L. When the fixing roller 41 is heated and the fixing housing 40H is warmed, air in a space A (FIG. 5) between the fixing housing bottom portion 40L and the heat insulation frame 10S is warmed. The density of this air decreases due to a temperature increase and the air tries to ascend. Here, the heat insulation frame 10S and the fixing housing bottom portion 40L are arranged horizontally to each other. However, as shown in FIG. 4, the leading end portion 10Sa of the heat insulation frame 10S is bent upward in advance (bent portion). Thus, the communication port 77 has a larger opening cross-sectional area than the first flow inlet E1. As a result, in the space A, pressure of air is lower on the side of the communication port 77 than on the side of the first flow inlet E1. Therefore, the air warmed in the space A becomes an air flow and moves toward the main body standing wall lower portion 10M. The air flow having reached the communication port 77 enters the second vertical air passage r22 (first vertical air passage r12) and, after ascending along the main body standing wall lower portion 10M and the main body standing wall upper portion 10H, is discharged from the louvers 75.

When the air warmed in the space A moves toward the main body standing wall lower portion 10M, the pressure in the space A becomes lower than the pressure of the air around the main conveyance path 22F. As a result, the air around the main conveyance path 22F flows into the space A through the first flow inlet E1. When the flowed-in air is warmed again, an air flow, which will move toward the main body standing wall lower portion 10M, is similarly formed.

As just described, in this embodiment, heat generated from the fixing roller 41 is transferred from the fixing housing bottom portion 40L to the air in the space A. This air produces a natural convection, enters the second vertical air passage r22 from the second horizontal air passage r21 and is discharged via the louvers 75. Since the louvers 75 are arranged on the upper end part of the main body standing wall upper portion 10H, the flow of warm air to the sheets stacked on the sheet discharging portion 13 is suppressed. Thus, the remelting of the toner image on the sheet is suppressed.

Further, the heat insulation frame 10S effectively insulates heat between the fixing unit 40 and the cleaning device 35. In addition, the laminar flow produced by the sheet being conveyed cools the cleaning device 35 and blocks heat transferred from the fixing unit 40 as an air curtain while passing along the first horizontal air passage r11. By cooling the cleaning device 35, the warmed air flow is discharged via the louvers 75 from the first vertical air passage r12.

By the above configuration, heat insulation between the fixing unit 40 and the cleaning device 35 is realized without providing such a dedicated fan as to directly blow an air flow to the fixing unit 40 and the cleaning device 35. This suppresses the softening and aggregation of the toner adhering to the cleaning blade 35B in the cleaning device 35. As a result, the adhesion of the softened and aggregated toner to the cleaning blade 35B is prevented.

Further, in this embodiment, the air flow having passed through the first horizontal air passage r11 and that exiting from the second horizontal air passage r21 join at the facing portion E3. Thus, the exhaust efficiency of each air flow is enhanced and a heat insulation effect between the fixing unit 40 and the cleaning device 35 is promoted more.

Further, according to the above embodiment, the air flow having entered the first horizontal air passage r11 enters the first vertical air passage r12 through the vents 76 formed in the heat insulation frame 10S. At this time, the air flow enters the first vertical air passage r12 while being squeezed to have a cross-sectional area corresponding to the opening cross-sectional area of the vents 76. Thus, the air flow entering the first vertical air passage r12 from the first horizontal air passage r11 and that entering the first vertical air passage r12 from the second horizontal air passage r21 are easily mixed.

Although the image forming apparatus 1 including the hot air exhaust passages according to the embodiment of the present disclosure has been described above, the present disclosure is not limited to this. For example, the following modifications can be made.

(1) Although the drum unit 30H is described as a target (toner containing unit) to be heat-insulated from the fixing unit 40 in the above embodiment, the target (toner containing unit) including the toner and to be heat-insulated from the fixing unit 40 is not limited to this. For example, the cleaner housing containing the cleaning device 35 or the development housing containing the developer or the toner inside may be heat-insulated as the toner containing unit from the fixing unit 40. Even in such a case, heat generated from the fixing unit 40 is insulated between the fixing unit 40 and the toner containing unit and exhausted, whereby the softening and aggregation of the toner are suppressed to prevent problems which occur in the toner containing unit.

(2) In the above embodiment, the heat insulation frame 10S is described to be a part of the frame supporting the main body housing 10. However, the heat insulation frame 10S is not limited to this. For example, the heat insulation frame 10S may be a bottom part of the fixing housing 40H. In this case, the heat insulation frame 10S forms the outermost wall of the fixing housing 40H and the fixing housing bottom portion 40L forms the wall portion at the inner side of the heat insulation frame 10S. Even in such a configuration, heat is effectively insulated between the fixing unit 40 and the cleaning device 35 by the first horizontal air passage r11 and the second horizontal air passage r21 formed above and below the heat insulation frame 10S. Further, by arranging the fixing housing 40H above and at the predetermined distance from the drum unit 30H, the first horizontal air passage r11 and the second horizontal air passage r21 are formed without arranging a frame member between the both.

(3) Further, in the above embodiment, the pressure is set to be lower on the side of the communication port 77 than on the side of the first flow inlet E1 in the space A by bending the leading end portion 10Sa of the heat insulation frame 10S to extend upward in advance. However, a configuration for exhausting the air warmed in the space A upward with a natural convection is not limited to this. For example, the fixing housing bottom portion 40L may be inclined slightly upward toward the main body standing wall lower portion 10M.

(4) Further, although the cooling fan 80 is provided to cool the board unit 70 in the above embodiment, there is no limitation to this. As described above, the present disclosure is configured to effectively insulate heat between the fixing unit 40 and the cleaning device 35 (toner containing unit) by a laminar flow generated by a sheet being conveyed. Thus, a laminar flow is generated by a sheet being conveyed and heat generation and heat exhaust effects are promoted even by a configuration not including the cooling fan 80.

Figure 7:
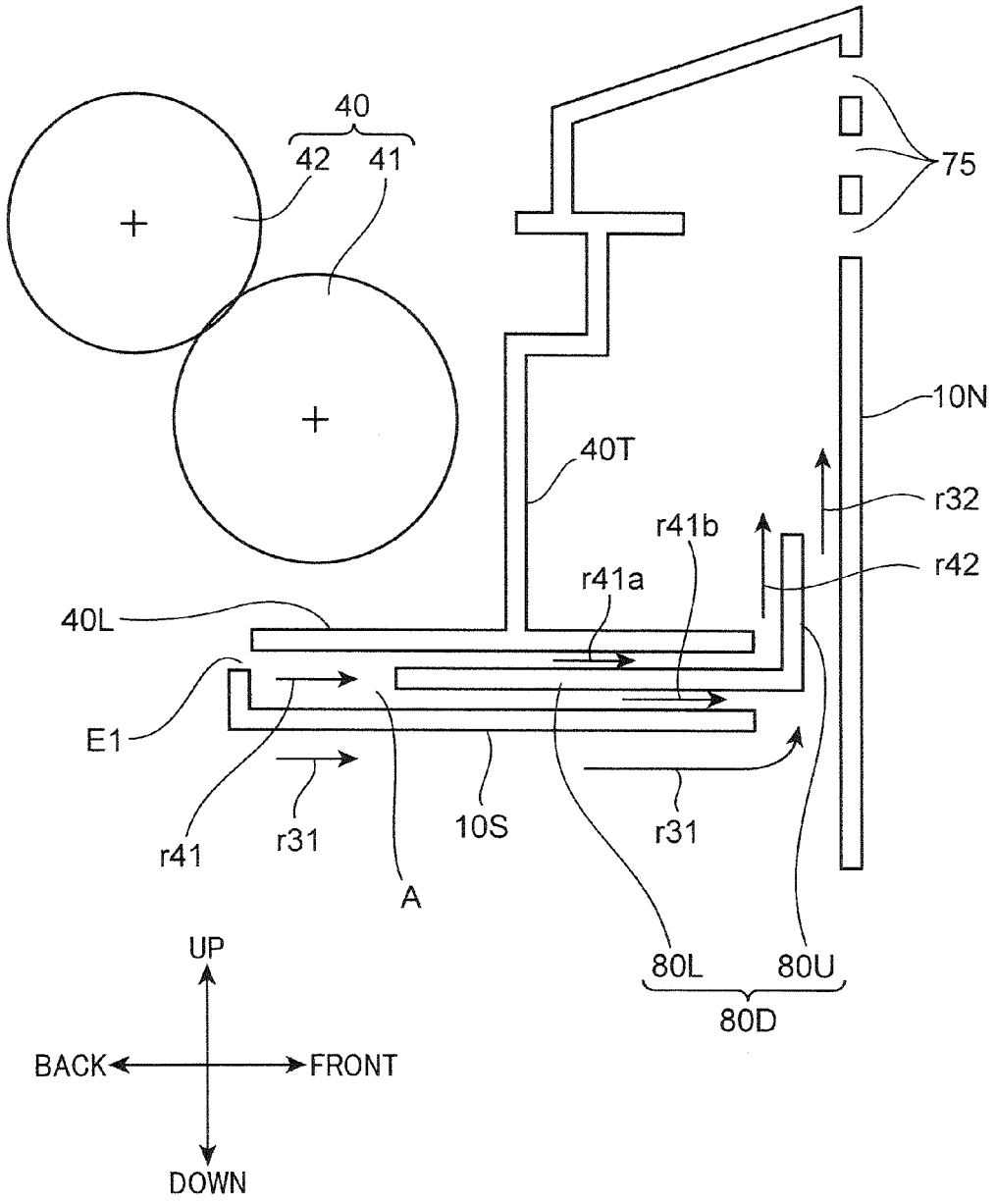
FIG. 7 is a sectional view for explaining hot air exhaust passages of an image forming apparatus according to another embodiment of the present disclosure.

(5) Furthermore, although the space A is an air layer in the above embodiment, there is no limitation to this. For example, fibers or a foamed material capable of causing air to flow inside may be filled in the space A. Further, a member for promoting the radiation of heat of the air inside may be arranged in the space A. For example, FIG. 7 is a diagrammatic sectional view when a heat radiation member 80D is arranged between the fixing housing bottom portion 40L and the heat insulation frame 10S.

The heat radiation member 80D is a plate made of a metal material having high heat radiation performance. The heat radiation member 80D includes a horizontal portion 80L (first surface) and a vertical portion 80U (second surface). The plate is bent in advance so that the vertical portion 80U intersects at a right angle to the horizontal portion 80L. The horizontal portion 80L is arranged between the fixing housing bottom portion 40L and the heat insulation frame 10S. The vertical portion 80U extends upward substantially at a right angle from the horizontal portion 80L near a main body standing wall 10N.

By arranging the heat radiation member 80D, a third horizontal air passage r31 is arranged below the heat insulation frame 10S and a third vertical air passage r32 perpendicular to the third horizontal air passage r21 is arranged to extend upward at a downstream side of the third horizontal portion r31. On the other hand, a fourth horizontal air passage r41 is split into a fifth horizontal air passage r41*a* and a sixth horizontal air passage r41*b* by the horizontal portion 80L between the heat insulation frame 10S and the fixing housing bottom portion 40L. Further, the third vertical air passage r32 and the fourth vertical air passage r42 are formed before and after the vertical portion 80U.

A laminar flow formed by a sheet being conveyed along the main conveyance path 22F is discharged to the outside of the apparatus from the louvers 75 via the third horizontal air passage r31 and the third vertical air passage r32. On the other hand, air warmed between the fixing housing bottom portion 40L and the heat insulation frame 10S moves toward the horizontal portion 80L in the fourth horizontal air passage r41. Then, this air flow is split into two upper and lower flows by the horizontal portion 80L. Out of the split air flows, the one moving along the fifth horizontal portion r41*a* collides with the vertical portion 80U to change its moving direction to move vertically upward and enters the fourth vertical air passage r42. The air flow moving upward along the fourth vertical air passage r42 joins the air flow having moved along the third vertical air passage r32 above the horizontal portion 80L. On the other hand, out of the air flows split by the horizontal portion 80L, the one moving along the sixth horizontal air passage r41*b* enters the third horizontal air passage r31 below the vertical portion 80U and is discharged to the outside of the apparatus via the third vertical air passage r32.

As just described, also in this embodiment, the air flow moving along the third horizontal air passage r31 and the two air flows split from the fourth horizontal air passage r41 finally join above the vertical portion 80U. Thus, the exhaust efficiency of each air flow increases. Further, in this embodiment, the horizontal portion 80L absorbs heat from the air flows moving in the fifth and sixth horizontal air passages r41*a* and r41*b* and transfers it to the vertical portion 80U. The heat transferred to the vertical portion 80U is radiated to the air flows ascending in the third and fourth vertical air passages r32, r42. Specifically, in this embodiment, the heat radiation member 80D functions as a heat sink and can transfer the heat generated from the fixing unit 40 in the plate and radiate the heat to the vertical air passage. Further, the heat radiation member 80D has a function of shielding infrared rays radiated from the fixing unit 40 to the cleaning device 35.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

The invention claimed is:

1. An image forming apparatus, comprising:

a housing;

a sheet conveyance path along which a sheet is conveyed from a lower side toward an upper side in the housing;

a toner containing unit which is arranged to face the sheet conveyance path at a first position of the sheet conveyance path and contains a toner inside;

a fixing unit which faces the sheet conveyance path at a second position of the sheet conveyance path downstream of the first position in a conveying direction and applies a fixing process to the sheet;

a fixing housing which houses the fixing unit and includes a wall portion facing the toner containing unit;

a heat insulation member, one end of which faces the sheet conveyance path, the other end of which extends away from the sheet conveyance path and which shields between the wall portion and the toner containing unit;

a first hot air exhaust passage which is arranged between the heat insulation member and the toner containing unit and into which an air flow in the sheet conveyance path enters from the one end of the heat insulation member;

a second hot air exhaust passage which communicates with the first hot air exhaust passage at the other end of the heat insulation member and allows the air flow having entered the first hot air exhaust passage to be exhausted upward;

a third hot air exhaust passage which is arranged between the wall portion and the heat insulation member and includes an opening facing the sheet conveyance path at the one end of the heat insulation member and a communication port communicating with the second hot air exhaust passage at the other end of the heat insulation member a sheet discharge opening arranged at a side of the sheet conveyance path downstream of the second position and through which the sheet is to be discharged;

a sheet discharging portion located below the sheet discharge opening and on which the sheet being discharged is to be placed; and a standing wall standing between the fixing housing and the sheet discharging portion;

wherein the second hot air exhaust passage is arranged between the fixing housing and the standing wall and the standing wall includes an exhaust port for allowing the air flow to be exhausted from the second hot air exhaust passage.

2. An image forming apparatus according to claim 1, wherein the first hot air exhaust passage and the second hot air exhaust passage are allowed to communicate with each other by a vent formed on the other end of the heat insulation member.

3. An image forming apparatus according to claim 1, wherein a cross-sectional area of the opening is smaller than that of the communication port.

4. An image forming apparatus according to claim 3, wherein:

the heat insulation member includes a bent portion formed by bending the one end toward the wall portion; and the opening is defined by the leading end of the bent portion and the wall portion.

5. An image forming apparatus according to claim 1, further comprising a plate-like member including a first surface extending in a horizontal direction and a second surface connected to the first surface and extending upward; wherein:

the first surface is arranged in the third hot air exhaust passage and the second surface is arranged in the second hot air exhaust passage.

6. An image forming apparatus according to claim 1, further comprising an image bearing member on the circumferential surface of which a toner image is to be formed and from which the toner image is to be transferred to the sheet at the first position; wherein:

the toner containing unit is an image bearing member unit supporting the image bearing member.

7. An image forming apparatus according to claim 1, further comprising a cleaning unit for cleaning a surface of an image bearing member, on the circumferential surface of which a toner image is to be formed; wherein:

the toner containing unit is a cleaner housing supporting the cleaning unit.

8. An image forming apparatus according to claim 1, wherein the heat insulation member is a frame member forming a part of the housing.

9. An image forming apparatus according to claim 1, wherein the heat insulation member is an outer wall portion of the fixing housing defining the fixing housing at an outer side of the wall portion.

* * * * *